US011250665B1

(12) United States Patent
Oberberger

(10) Patent No.: US 11,250,665 B1
(45) Date of Patent: Feb. 15, 2022

(54) METHOD AND APPARATUS ALLOWING A WAGER TO BE PLACED TO PREDICT A SECOND SEGMENT IN A SEQUENCE OF VISUAL NARRATIVE SEGMENTS

(71) Applicant: Michael Oberberger, Spring Hill, TN (US)

(72) Inventor: Michael Oberberger, Spring Hill, TN (US)

( * ) Notice: Subject to any disclaimer, the term of this patent is extended or adjusted under 35 U.S.C. 154(b) by 0 days.

(21) Appl. No.: 15/673,960

(22) Filed: Aug. 10, 2017

(51) Int. Cl.
*G07F 17/32* (2006.01)

(52) U.S. Cl.
CPC ..... *G07F 17/3244* (2013.01); *G07F 17/3209* (2013.01); *G07F 17/3211* (2013.01); *G07F 17/3225* (2013.01); *G07F 17/3288* (2013.01)

(58) Field of Classification Search
CPC ..... G07F 17/3244; G07F 17/3211; G07F 17/3225; G07F 17/3209; G07F 17/3288
See application file for complete search history.

(56) References Cited

U.S. PATENT DOCUMENTS 8,303,392 B2 11/2012 Stromer
8,632,392 B2 1/2014 Shore et al.
8,758,112 B2 6/2014 Lyons et al.
8,882,583 B2 11/2014 Barbalet et al.
9,483,908 B2 11/2016 Shore et al.
2002/0118679 A1* 8/2002 Eyer ..... H04N 21/4344 370/389
2003/0064807 A1* 4/2003 Walker ..... G07F 17/32 463/42
2004/0204228 A1* 10/2004 Walker ..... G07F 17/3244 463/20
2005/0277457 A1* 12/2005 Wilson ..... G07F 17/3267 463/12
2006/0205471 A1 9/2006 Martin et al.
2006/0258446 A1* 11/2006 Nguyen ..... G07F 17/32 463/30
2010/0075750 A1* 3/2010 Bleich ..... G07F 17/3216 463/30
2012/0115590 A1* 5/2012 Rowe ..... G07F 17/32 463/25
2013/0059638 A1* 3/2013 Nicely ..... G07F 17/322 463/17
2013/0116032 A1* 5/2013 Lutnick ..... G07F 17/3276 463/17
2015/0087377 A1* 3/2015 Yee ..... G07F 17/3286 463/17
2015/0151190 A1* 6/2015 Durbin ..... A63F 1/00 273/292
2015/0190726 A1* 7/2015 Frolov ..... A63G 31/16 472/61
2015/0294527 A1 10/2015 Kolomiiets et al.
2016/0059135 A1 3/2016 Wright et al.
2017/0132875 A1* 5/2017 Freedman ..... G07F 17/3288
2018/0218571 A1* 8/2018 Kelly ..... G06F 17/3005

* cited by examiner

*Primary Examiner* — Thomas J Hong
*Assistant Examiner* — Carl V Larsen
(74) *Attorney, Agent, or Firm* — Young Law Firm, P.C.

(57) ABSTRACT

A method and apparatus for playing a wagering game where the objective is to predict a second segment in a sequence of visual narrative segments presented in a series comprising a first segment and a second segment, where each visual narrative segment in the series shows one or more events depicted in visual form as a video, film, or animation.

12 Claims, 16 Drawing Sheets

METHOD AND APPARATUS ALLOWING A WAGER TO BE PLACED TO PREDICT A SECOND SEGMENT IN A SEQUENCE OF VISUAL NARRATIVE SEGMENTS

TECHNICAL FIELD

The present disclosure relates generally to a method for playing a wagering game and a system for its implementation. More particularly, the present disclosure relates to a method and apparatus for playing a wagering game where the objective is to predict a second segment in a sequence of visual narrative segments comprising a first segment and a second segment.

BACKGROUND

Casino wagering games have a number of drawbacks when it comes to attracting and retaining players who may be unfamiliar with casino gambling or who have become disenchanted with traditional casino games. Many wagering games, including card games such as blackjack and poker, are heavily mathematical and it may prove difficult for beginning or casual players to grasp the nuances of the game or develop the skill necessary to enjoy the experience. Other games, such as slot machines and lottery games, offer a very repetitive experience and are dependent on pure chance. Such games may offer the player very little in return for their money in terms of both reward and entertainment value. Furthermore, the experience of playing most casino games can be a lonely one, as many games are either played solo or against a machine. Similarly, many games force players into adversarial and intimidating situations where each player is pitted against the dealer or other players where high stakes are often involved.

Therefore, there is a need for a wagering game that is not only accessible and easy to grasp for beginning players, but which is also highly entertaining and offers a chance for social interaction while still providing the excitement of the potential risk and reward involved in a casino game.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a method and apparatus for allowing at least one player in a wagering game to place at least one wager predicting a second segment in a sequence of visual narrative segments comprising a first segment followed by a second segment. The first segment comprises an introduction segment having a plurality of possible outcome segments, and the second segment corresponds to a possible outcome segment randomly selected from amongst the plurality of possible outcome segments. Each visual narrative segment comprises a video, film, or animation depicting one or more events in visual form, and the combined sequence of visual narrative segments can portray a humorous, dramatic, or suspenseful narrative designed to capture the interest of the players. Players may view each visual narrative segment and relevant game information on at least one gaming display. At the start of the game, each player is presented with the first segment, such as an introduction segment. After each player has viewed the introduction segment, each player is then presented with a list of betting options, with each betting option in the list corresponding to one of the plurality of possible outcome segments associated with the introduction segment. Each betting option may further indicate the odds of each possible outcome segment being selected from the plurality of possible outcome segments. Each player may place a wager comprising an outcome prediction and a wager amount, where the outcome prediction is a prediction of which possible outcome segment will be selected as the second segment, and the wager amount is a quantity of a game currency. Once each player has finished placing a wager, a random outcome selector comprising an electronic random number generator, a deck of cards, a roulette wheel, a set of one or more dice, or other gaming apparatus commonly employed in wagering games, randomly selects one possible outcome segment from amongst the plurality of possible outcome segments, and the selected possible outcome segment is presented to each player as the second segment. Any wager with an outcome prediction matching the second segment is a winning wager. Each player who has placed a winning wager is a winning player and receives an award, while each player who placed a losing wager is a losing player and loses the wager amount. The wagering game therefore combines the broad, accessible appeal of viewing a compelling visual narrative with the excitement inherent in a wagering game offering risk and reward.

According to an aspect of an embodiment of the present disclosure, each winning player can be invited to participate in an extended play game, where the previously presented second segment becomes an extended first segment in a sequence of visual narrative segments comprising an extended first sequence and an extended second sequence, where the extended first segment has a plurality of possible extended outcome segments. The object of the extended play game is to predict which possible extended outcome segment will be randomly selected as the extended second segment. Each extended possible outcome segment may further have a plurality of possible extended outcome segments, allowing the extended play game to be played for several successive games, which provides an incentive for players to view the remainder of the sequence of visual narrative by continuing to play and win.

In a further aspect of an embodiment in accordance with the present disclosure, after the conclusion of each game, each player may choose to participate in a replay game, where the previous game is repeated with the same introduction segment and associated plurality of possible outcome segments. In the replay game, when each player is presented with a list of betting options, the player may choose to remove one of the betting options and its associated possible outcome segment. The removed possible outcome segment will not be selected by the random outcome selector.

In yet a further aspect of an embodiment of the present disclosure, the game can be played as a team game, where a team comprises two or more players, and each team places a team wager. The team game offers players a chance to socialize and play cooperatively towards a common goal. Accordingly, the game can be played as a competitive team game between at least two teams, where all awards are placed in a competitive pot and the team with the highest score may be awarded the game currency contained in the competitive pot.

It is an aspect of an embodiment of the present disclosure to provide a visual narrative repository implemented as a database containing a plurality of visual narrative segments for use in the game, where each visual narrative segment in the repository is categorized according to at least one segment characteristic. Before the start of a game, each player can choose a visual narrative segment to be used as the first segment based on one or more segment characteristics.

It is a further aspect of an embodiment of the present disclosure for a game to be played in a live setting comprising a gaming table attended by a dealer.

Accordingly, it is yet a further aspect of an embodiment of the present disclosure to provide a game system comprising at least one gaming display, at least one gaming server, and at least one gaming machine. The game system may be configured to run an electronic version of the wagering game, and can also be integrated into a wagering game played in a live setting such as at a table in a casino or in a pub or restaurant.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

In an embodiment in accordance with the present disclosure, a wagering game is played by at least one player, where each player is shown a sequence of visual narrative segments, where each visual narrative segment comprises a film, video, or animation depicting a series of one or more events in visual form. The sequence of visual narrative segments comprises a first segment followed by a second segment. The first segment comprises an introduction segment having a plurality of possible outcome segments, followed by a second segment randomly selected from amongst the plurality of possible outcome segments. The objective of the wagering game is for the player to predict which possible outcome segment from amongst the plurality of possible outcome segments will be randomly selected as the second segment. Accordingly, each player may place a wager comprising an outcome prediction and a wager amount. A wager where the outcome prediction matches the second segment is a winning wager, while a wager where the outcome prediction does not match the second segment is a losing wager. Each player who has placed a winning wager will receive an award, while each player who has placed a losing wager will lose the wager amount.

Figure 1:
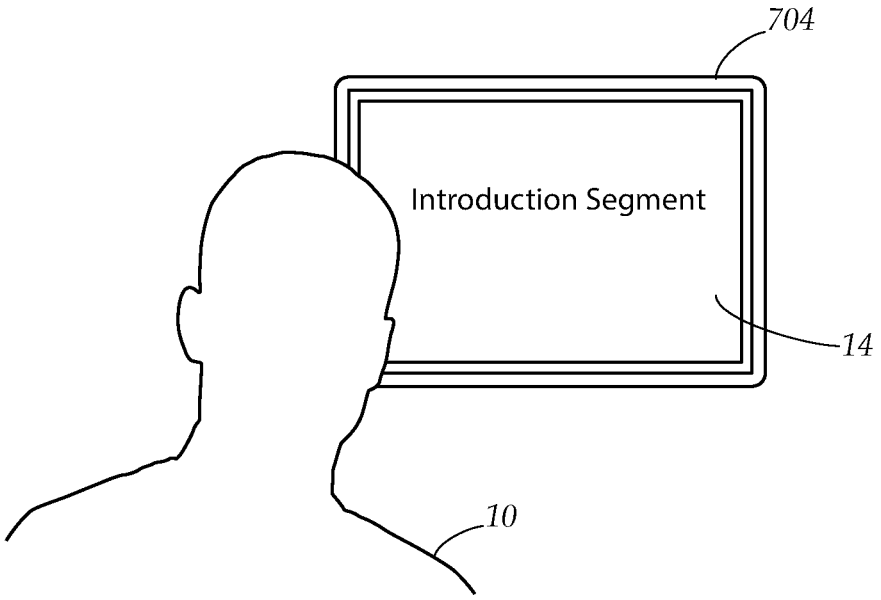
FIG. 1 is a depiction of a player viewing an introduction segment, in accordance with an embodiment of the present disclosure.

FIG. 1 illustrates a player 10 viewing a first segment comprising an introduction segment 14 on a gaming display 704. The gaming display 704 comprises a display utilizing LCD, LED, CRT, or other video display technology and may further comprise a video playback device configured to play the visual narrative segment. Once each player has viewed the introduction segment 14, the gaming display will show a summary of each possible outcome segment associated with the introduction segment. For example, the introduction segment may depict a video of a man climbing a vertical cliff face, and each summary of one of the possible outcome segments may describe an event which may occur involving the man while he climbs the vertical cliff face.

Figure 2:
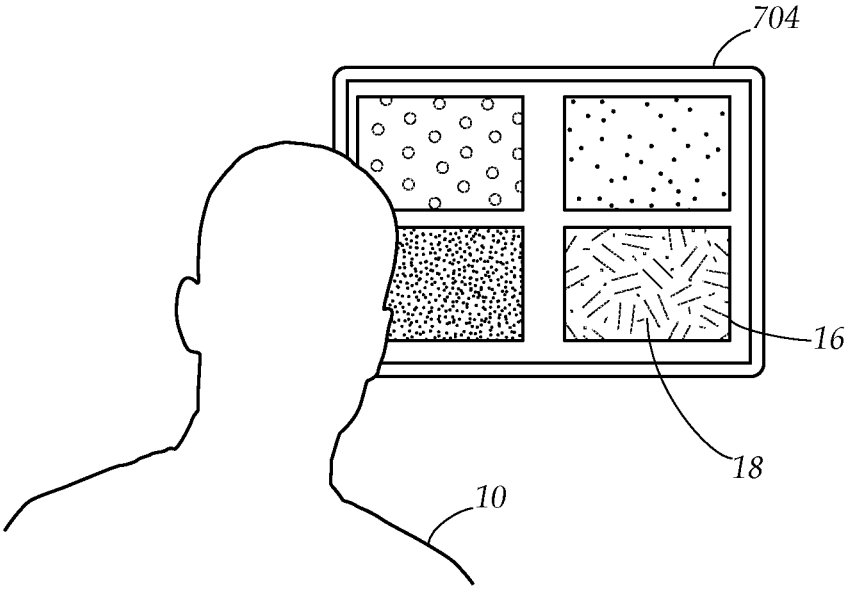
FIG. 2 depicts the player viewing a list of possible outcomes to the introduction segment, in accordance with an embodiment of the present disclosure.

FIG. 2 depicts the player 10 viewing a list 16 of possible outcome segments 18 on the gaming display 704. Each possible outcome segment 18 may reflect a possible outcome that may occur as a result of the events depicted in the introduction segment 14 (FIG. 1). For example, the possible outcome segments may comprise the following: A) The man reaches the top of the cliff, B) The man is overtaken by a little girl, C) The man is attacked by a dinosaur, and D) The man falls off the cliff face. Once each player has viewed the list 16 of possible outcome segments 18, each player is then presented with a list of betting options, where each betting option corresponds to one of the possible outcome segments.

Figure 3:
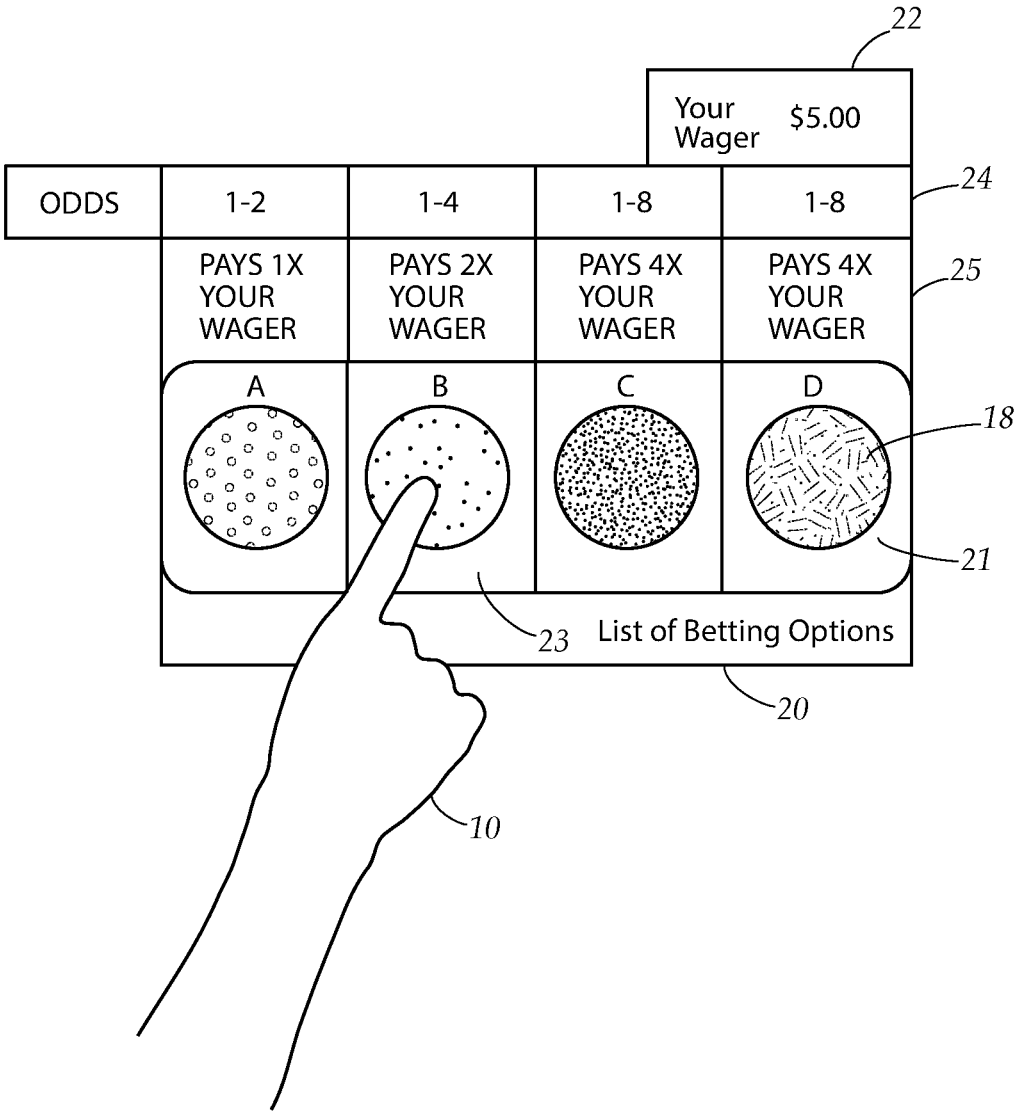
FIG. 3 depicts the player selecting a betting option and placing a wager, in accordance with an embodiment of the present disclosure.
Figure 4A:
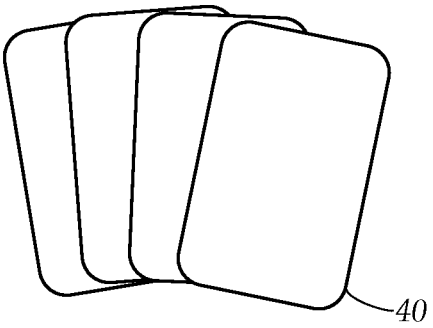
FIGS. 4A-D depict a variety of wagering game apparatus which can be used as a random outcome selector in accordance with an embodiment of the present disclosure.
Figure 4B:
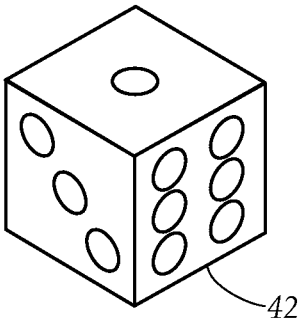
Figure 4C:
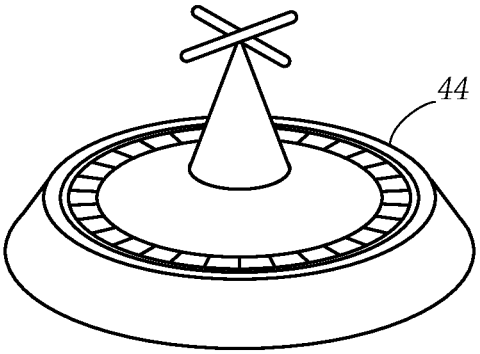
Figure 4D:
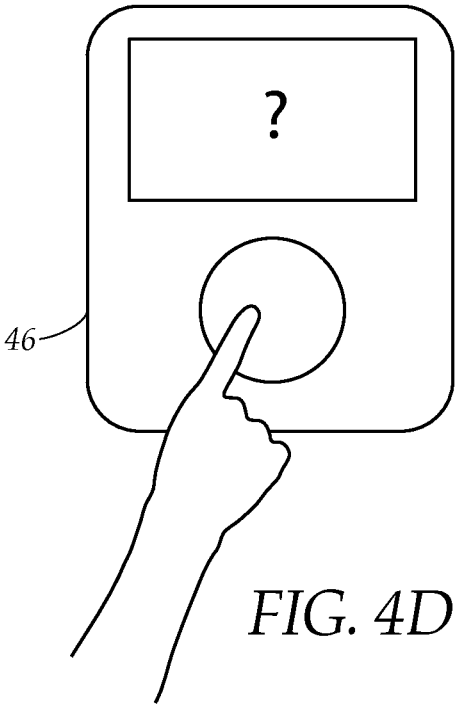

FIG. 3 depicts the player 10 being presented with a list of betting options 20, where each betting option 21 allows the player to choose an outcome prediction corresponding to one of the possible outcome segments 18 associated with the introduction segment 14 (FIG. 1). Each betting option 21 also includes an outcome probability 24 which reflects the odds that the particular possible outcome segment will be randomly selected as the second segment, and an award factor 25, which indicates the amount of an award that the player will receive for a winning wager. The outcome probability 24 may be tailored to reflect the likelihood that a particular outcome will occur based on the narrative events depicted in the first segment. For example, a logical but mundane outcome to the narrative may be assigned a high outcome probability 24, while an exciting but unlikely outcome may be assigned a low outcome probability 24. The award factor 25 can be expressed as a multiple of the player's wager amount, with betting outcomes with a lower outcome probability having a higher award factor. The award can represent a fixed amount of game currency. The award may also represent a non-monetary award such as a chance to play a wagering game for free, a discount on merchandise or services, or other perk or benefit to the player. The player 10 may place a wager by selecting one of the betting options 21 and then setting a wager amount 22. The wager amount comprises a quantity of a game currency, such as dollars, which can be virtual currency or real currency. Here, the player 10 has selected betting option "B" 23, and set the wager amount 22 as $5. Once all wagers have been placed, a random outcome selector is used to select one of the possible outcome segments.

FIGS. 4A-D depict a variety of apparatus commonly used in wagering games which can be configured to function as the random number selector, such as a deck of cards 40, at least one dice with varying numbers of sides 42, a roulette wheel 44, and an electronic random number generator 46. Other methods and apparatus suitable for use as a random outcome will be apparent to one of ordinary skill in the art in the field of the invention. The random outcome selector produces a plurality of random outcomes, which can be divided into a plurality of ranges where each range comprises at least one random outcome. Each range corresponds to one particular possible outcome segment in the plurality of possible outcome segments represented by the list of betting options. If the random outcome selector generates a random outcome falling within a particular range, the possible outcome segment corresponding to that range will be selected. For example, when the random outcome selector is implemented as a deck of cards 40, a particular range may be represented by a specific card or group of cards within the deck, and drawing that card or group of cards will result in the possible outcome segment associated with the particular range being selected. Returning to FIG. 3, if the possible outcome segment represented by betting option "B" 23 has an outcome probability of "1 in 4", the random outcome selector will select the possible outcome segment twenty-five percent of the time. For example, if the random outcome selector is configured as a deck of eight cards, the range of random outcomes corresponding to the possible outcome segment of betting option "B" 23 would comprise two cards. If either of those two cards are selected, the possible outcome segment of betting option "B" would be selected as the second segment. The random outcome selector can also be implemented as a virtual random outcome selector comprising an electronic simulation replicating the functions of the deck of cards, dice, the roulette wheel, or other apparatus for generating a random outcome as described in the present disclosure.

Figure 5:
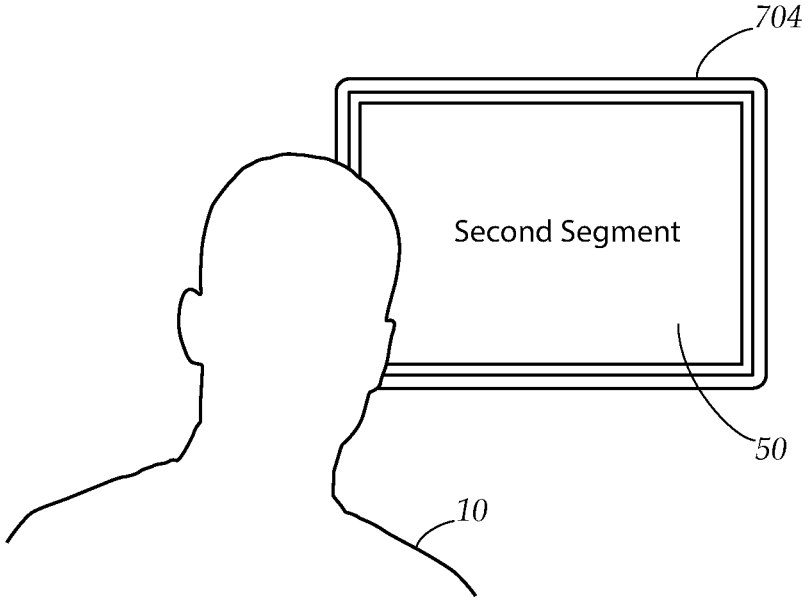
FIG. 5 depicts the player viewing the second segment, in accordance with an embodiment of the present disclosure.

Once the random outcome selector has selected a particular possible outcome segment, the selected possible outcome segment is presented to the player 10 as the second segment. In FIG. 5, the gaming display 704 is depicted showing the player 10 the second segment 50, which corresponds to the possible outcome segment of betting option "B" (FIG. 3). In the present example, the player 10 is presented with a visual depiction of a little girl overtaking the man as he climbs the vertical cliff face.

Figure 6:
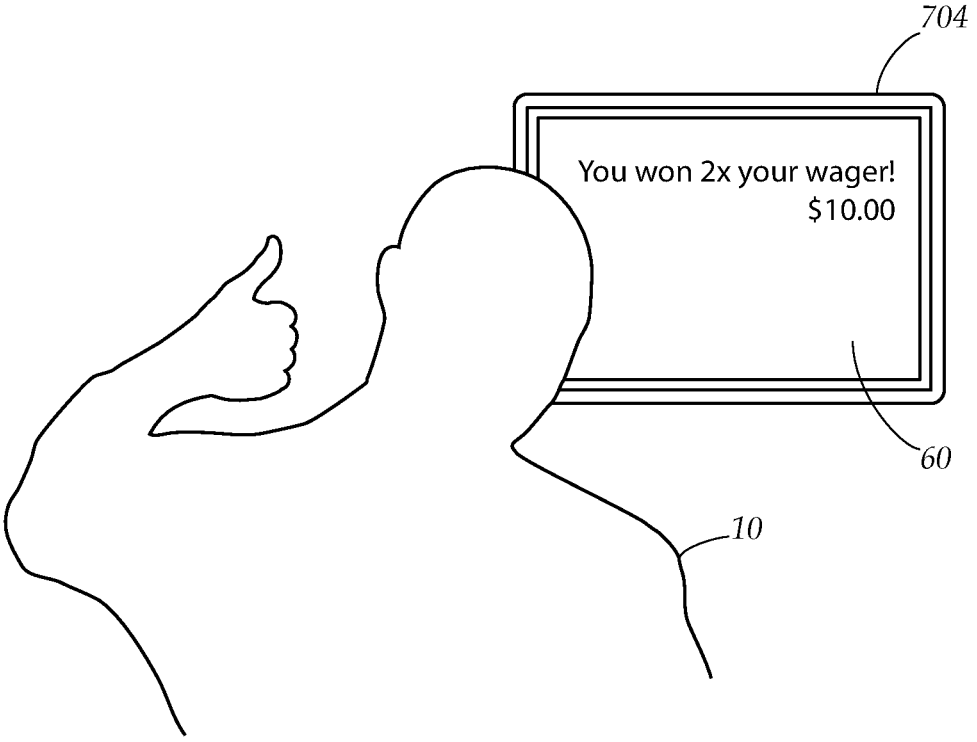
FIG. 6 depicts the player being shown the award for having placed a winning wager, in accordance with an embodiment of the present disclosure.

In FIG. 6, the gaming display 704 shows the player 10 a winnings summary 60 indicating that the player has placed a winning wager, along with a message displaying the award amount. Here, the player placed a bid with a wager amount 22 of $5 as shown in FIG. 3, and receives an award of $10 equal to the wager amount 22 multiplied by the award factor 25 of 2×.

Figure 7:
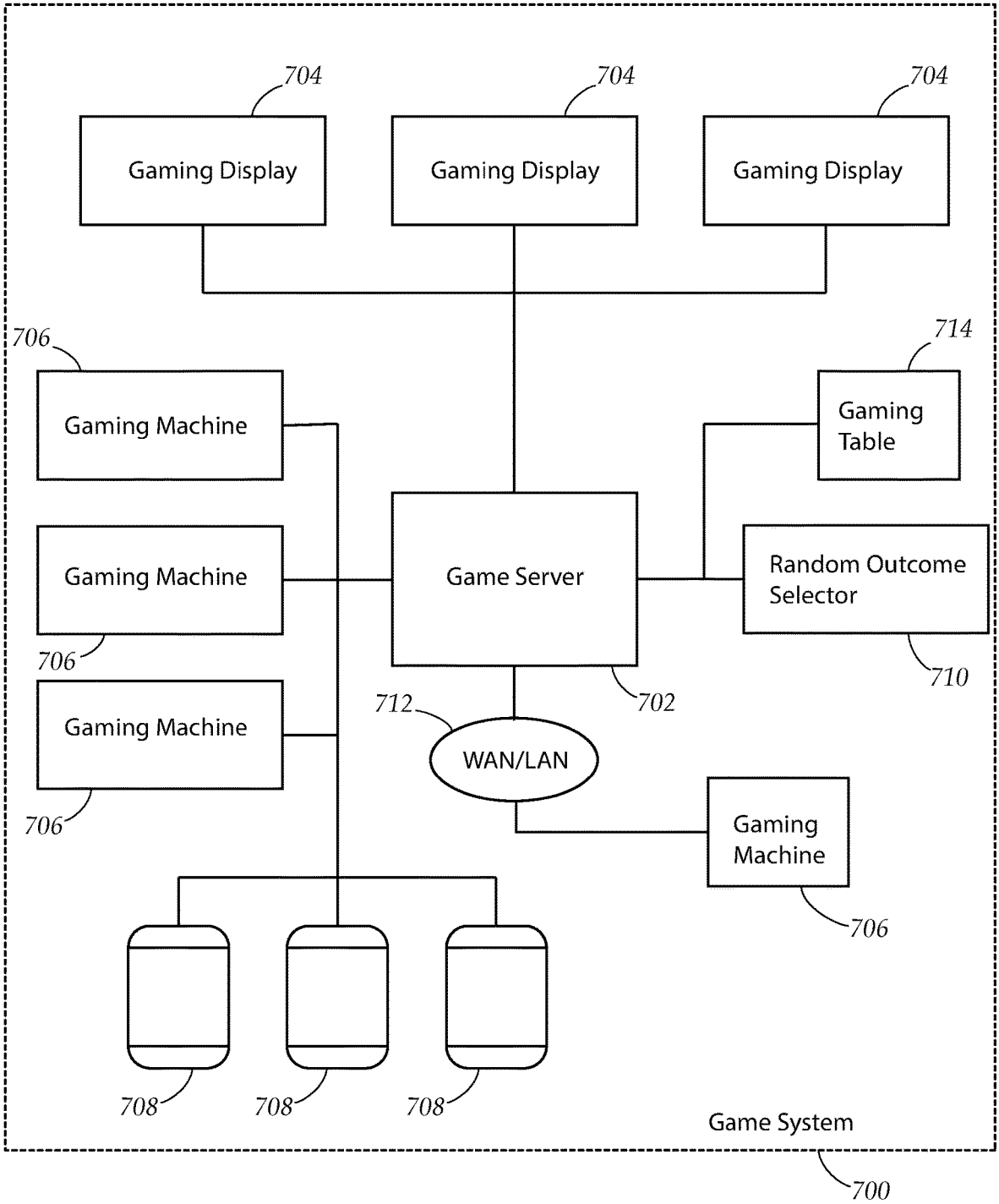
FIG. 7 depicts a diagram showing an example of a game system, in accordance with an embodiment of the present disclosure.

FIG. 7 depicts an exemplary game system 700 in accordance with an aspect of the present disclosure. The wagering game can be implemented on a game system 700 comprising at least one game server 702, at least one gaming display 704, and at least one gaming machine 706. Each gaming display 704 and each gaming machine 706 are connected to the game server 702 via a LAN or WAN 712 environment. The system may further include at least one personal computing device 708, such as a smartphone or tablet, and at least one random outcome selector 710. The game system 700 may be implemented in a gaming venue, such as a casino, restaurant, pub, or other location.

The primary function of the game server 702 is to store a plurality of visual narrative segments which can then be transmitted to the at least one gaming display 704 and the at least one gaming machine 706 via the LAN or WAN 712, to be presented to a player. Each player may view visual narrative segments presented by the at least one gaming display 704 deployed at various locations within the gaming venue. The game system 700 may also comprise at least one gaming table 714 attended by a dealer for playing the wagering game as a live game. Furthermore, a gaming display 704 may be integrated within a gaming machine 706 or a gaming table 714. Each player may play the wagering game by joining a live game at any gaming table 714, or by interacting with any gaming machine 706. The dealer can receive wagers, operate the random outcome selector 710 to select the second segment, present visual narrative segments on a gaming display 704, distribute awards, and perform other tasks necessary to allow a live game to be played. Similarly, each gaming machine 706 can be configured to receive wagers, select the second segment using a virtual random outcome selector implemented on the gaming machine, present visual narrative segments on a gaming display 704, distribute awards, and perform other functions as necessary to allow the wagering game to be played.

Figure 8A:
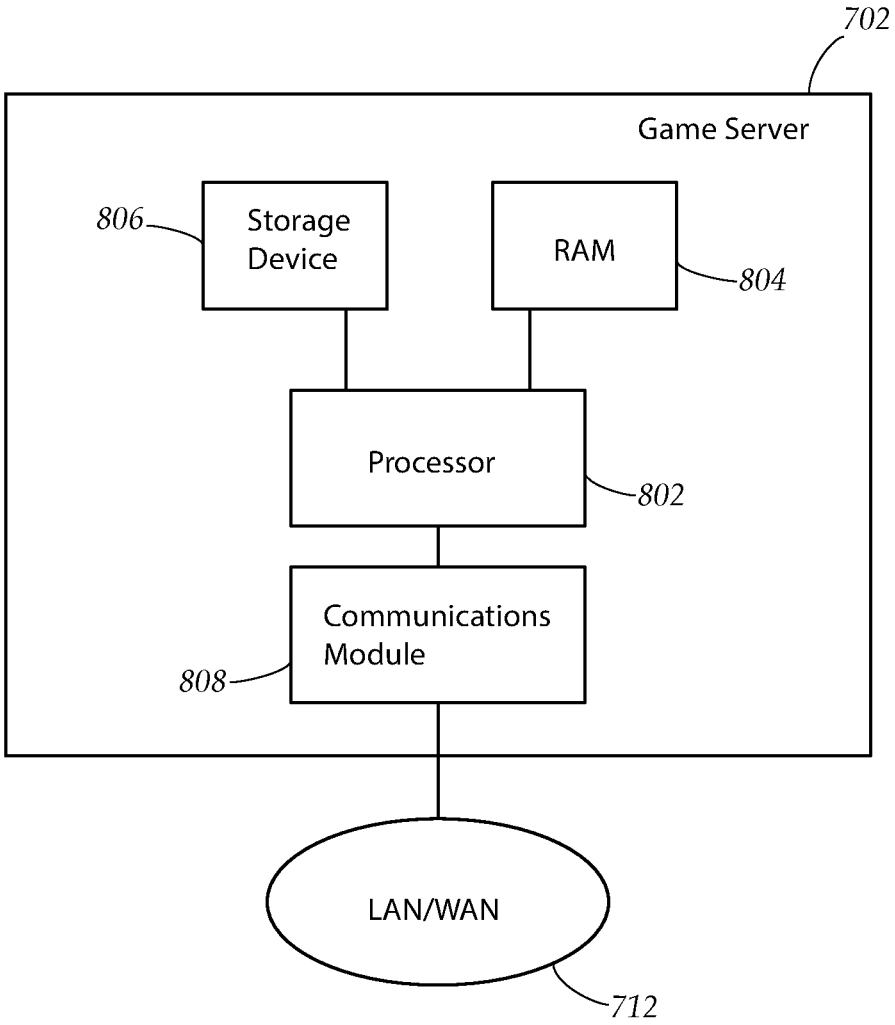
FIGS. 8A-B depict diagrams of examples of a gaming server, and a gaming machine, in accordance with an embodiment of the present disclosure

FIG. 8A depicts a block diagram of an exemplary game server 702 within the game system 700 depicted in FIG. 7.

The game server 702 comprises at least one game server processor 802 configured to control the functions of the game server 702, at least one game server RAM 804, at least one game server storage device 806 configured to store a plurality of visual narrative segments, and at least one game server communications module 808 configured to communicate with the game system via a LAN or WAN 712.

Figure 8B:
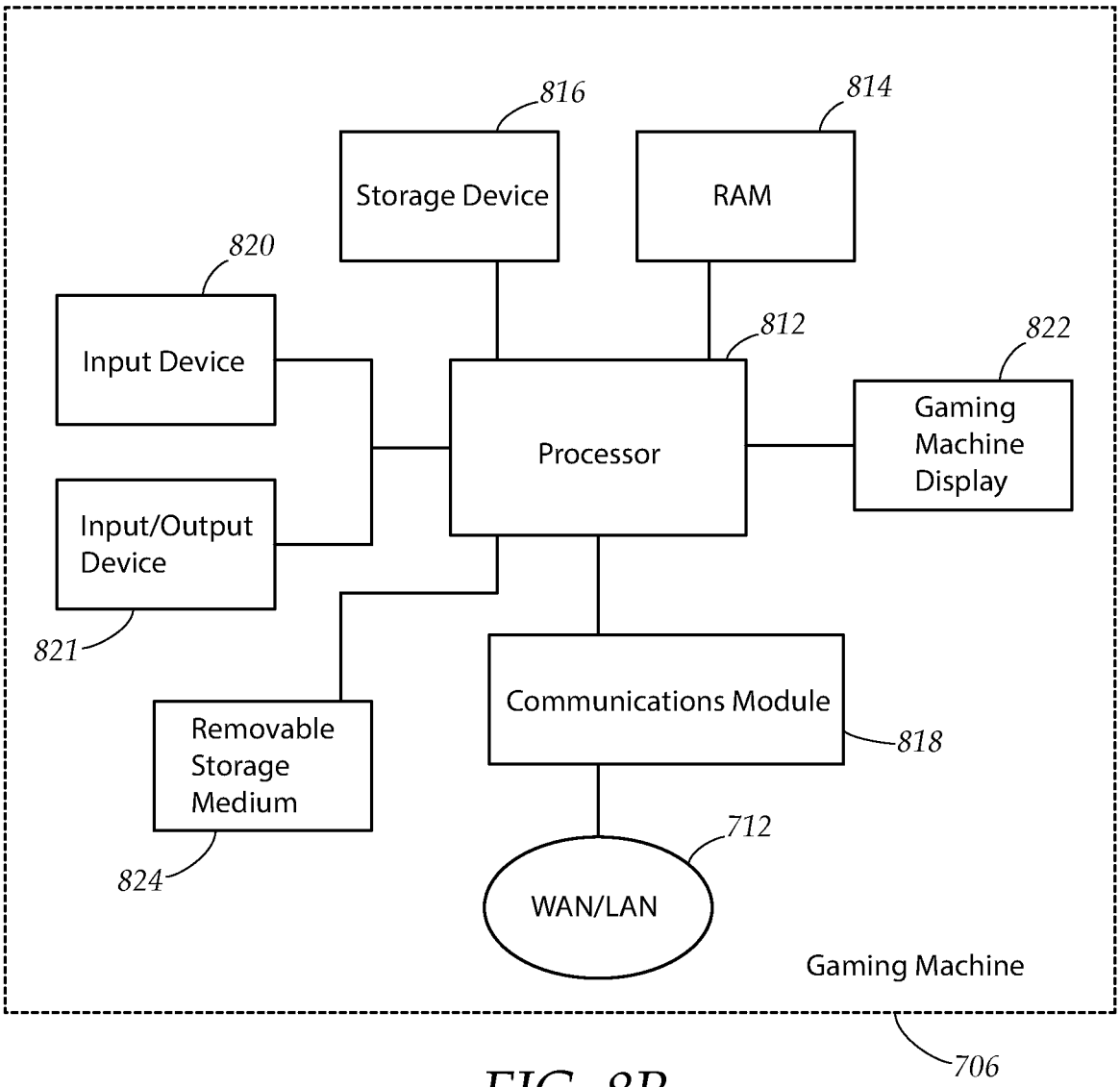

FIG. 8B depicts a block diagram of an exemplary gaming machine 706 within the game system 700 depicted in FIG. 7. The gaming machine 706 comprises at least one gaming machine processor 812 configured to control the functions of the gaming machine 706, at least one gaming machine RAM 814, at least one gaming machine storage device 816 for storing visual narrative segments, at least one gaming machine communications module 818 for communicating with the LAN/WAN 712, and at least one gaming machine input device 820. The gaming machine may be further configured with at least one gaming machine display 822 for presenting visual narrative segments to each player. The gaming machine 706 is configured to receive an input from a player via the at least one gaming input device 820, such as placing a wager by selecting a betting option and setting the wager amount. The gaming machine input device 820 may be a touchscreen incorporated into the gaming machine display 822, or a button, switch, lever, or other apparatus commonly employed in casino gaming equipment. The gaming machine 706 may further comprise at least one input/output device 821 such as a card reader, a ticket reader, a printer, a currency receptacle for accepting game currency in the form of a bill, coin or a token, a coin output for dispensing coins or tokens, or other apparatus commonly employed in casino gaming equipment. The gaming machine 706 may further be configured to retrieve visual narrative segments from the game server 702 as shown in FIG. 7. Returning to FIG. 8B, the retrieved visual narrative segments may be stored within the gaming machine storage device 816, and be presented on the gaming machine display 822. In an alternate embodiment of the present disclosure, the gaming machine 706 may be configured with at least one removable storage medium 824 for storing a plurality of visual narrative segments such as a removable hard disk drive, an optical disc reader with video or data optical discs, or a memory card reader and memory cards. Implementing the gaming machine 706 with the removable storage medium 824 allows visual narrative segments to be retrieved from the removable storage medium 824, stored on the gaming machine storage device 816, and presented on the gaming machine display 822 without the use of a game server, allowing the game machine 706 to operate independently of the gaming system 700 depicted in FIG. 7. Furthermore, the at least one personal computing device 708 as shown in FIG. 7 may be configured to function as a gaming machine 706, using a personal computing input device integrated into the personal computing device 708 to allow a player to place a wager and send wagering game related information to the game server 702 by connecting to the LAN 712 via a wireless technology such as WIFI.

Figure 9:
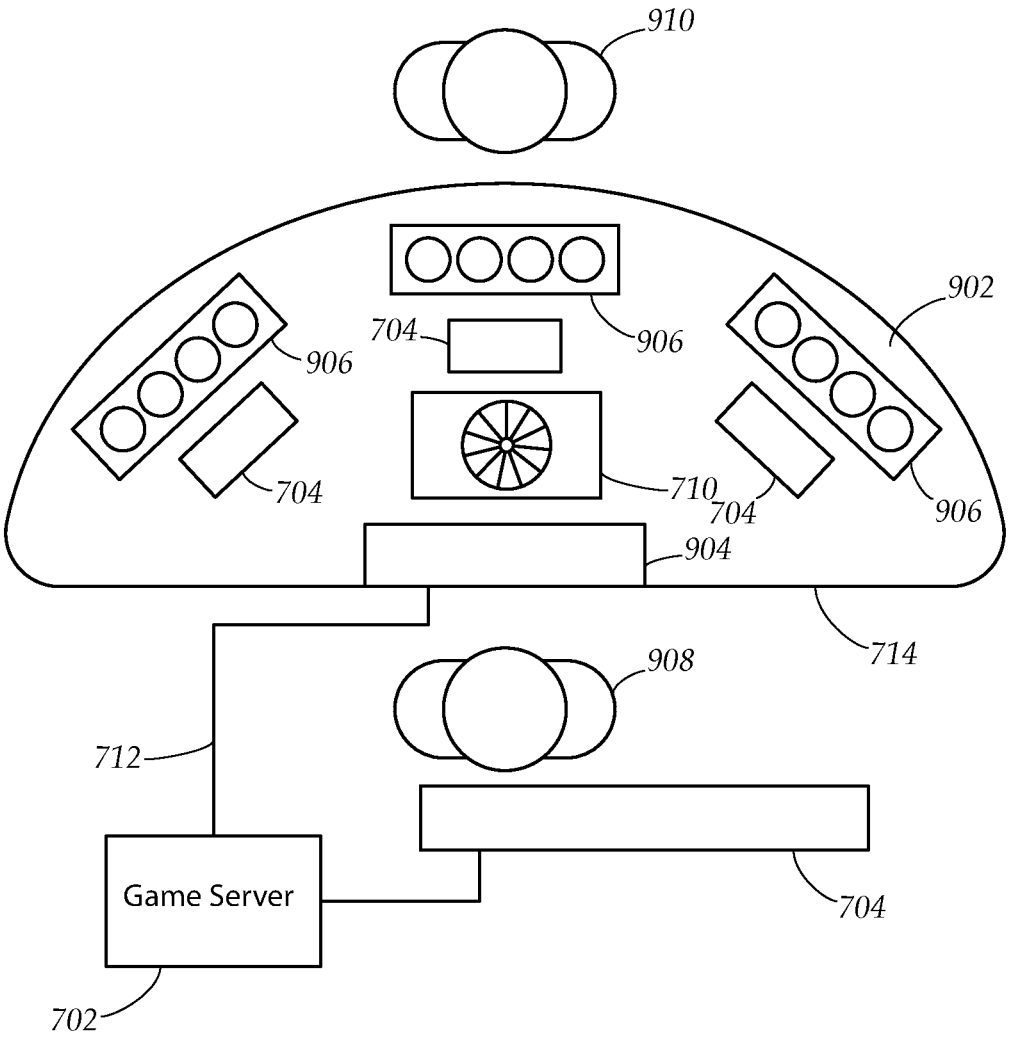
FIG. 9 depicts a gaming table for playing the wagering game, in accordance with an embodiment of the present disclosure.

FIG. 9 shows a plan view diagram depicting an embodiment of a gaming table 714 within the game system 700 depicted in FIG. 7. The gaming table 714 comprises a game table surface 902, and at least one betting area 906 disposed on the gaming table surface 902. Each at least one betting area 902 is configured to allow the player 910 to place a wager. The gaming table 714 further comprises a gaming table control unit 904 operated by a dealer 908, where the gaming table control unit 904 is configured to connect with the game server 702 via the LAN or WAN 712, allowing the dealer to communicate with the gaming server 702 to retrieve and present visual narrative segments on a gaming display 704. The at least one gaming display 704 can be positioned on the gaming table surface 902 or near the gaming table 714 in view of the player 910, such as behind the dealer 908. The gaming table 714 further comprises a random outcome selector 710, which can be operated by the dealer 908 to determine the second segment.

Figure 10A:
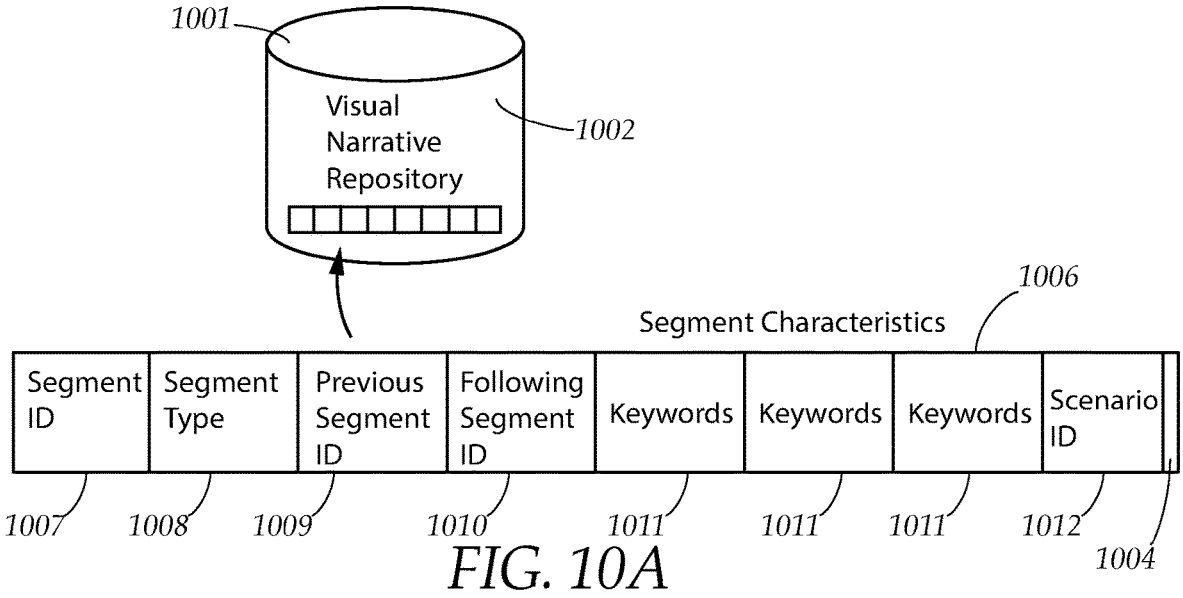
FIG. 10A and FIG. 10B depicts a visual narrative repository implemented in a database format, in accordance with an embodiment of the present disclosure.
Figure 10B:
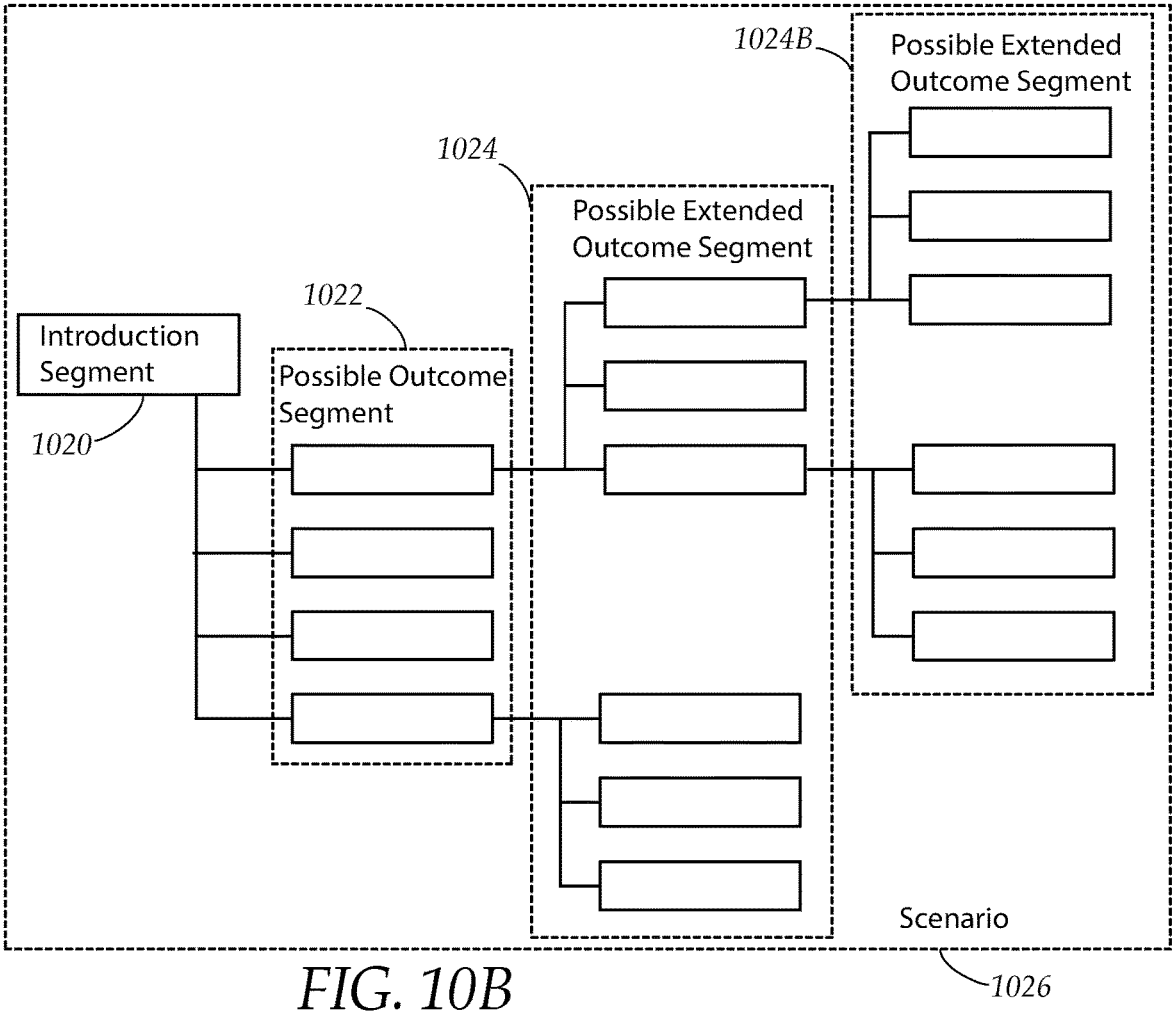

The plurality of visual narrative segments employed in the wagering game can be stored in a database format as a visual narrative repository to allow for each of the plurality of visual narrative segments to be categorized for retrieval in the game system 700 as depicted in FIG. 7. FIG. 10A depicts a visual narrative repository 1001 stored within a computer readable medium 1002. The computer readable medium can be the game server storage device 806 as shown in FIG. 8A, the gaming machine storage device 816 depicted in FIG. 8B, or the removable storage medium 824 also depicted in FIG. 8B. The total number of visual narrative segments available for use in the wagering game can be distributed between multiple visual narrative repositories to account for storage capacity limitations in the various storage devices integrated within the elements of the game system 700 depicted in FIG. 7. Each visual narrative segment may be stored as a video file in a variety of different formats commonly employed for digital video playback. Visual narrative segments may also be encoded as tracks on optical video discs such as DVDs or Blu-Ray discs. Furthermore, a visual narrative segment may comprise a computer-generated animation implemented through a gaming machine 706 as described in FIG. 7. It would be apparent to a person of ordinary skill in the art in the field of the invention to choose a medium or video file format best suited based on the desired video quality, available storage capacity, and other relevant considerations. Each visual narrative segment stored within the visual narrative repository 1001 has a corresponding repository entry 1004 with data fields comprising a plurality of segment characteristics 1006. The plurality of segment characteristics may comprise a segment ID 1007 which identifies the visual narrative segment, and a segment type 1008 which indicates whether the visual narrative segment is an introduction segment, a possible outcome segment, or an extended possible outcome segment. The plurality of segment characteristics 1006 may also comprise a following segment ID 1010 and a previous segment ID 1009. The following segment ID 1010 identifies which other visual narrative segments may be played in the sequence of visual narrative segments subsequent to the visual narrative segment, such as each possible outcome segment associated with the visual narrative segment. The previous segment ID 1009 identifies the visual narrative segment that can precede the visual narrative segment in the sequence. Accordingly, the plurality of segment characteristics 1006 can further comprise a scenario ID 1012. Referring to FIGS. 10A and 10B simultaneously, the introduction segment 1020, along with each of its associated possible outcome segments 1022, and any extended possible outcome segments 1024 associated with each of the possible outcome segments 1022, collectively comprise a scenario 1026 identified by the scenario ID 1012. The plurality of segment characteristics may further comprise a keyword 1011. Each keyword 1011 may be an author ID indicating the creator of the visual narrative segment, and a genre ID indicating the applicable genre of the visual narrative segment, such as drama, humor, animal, suspense, or other suitable description. The visual narrative repository

1001 therefore allows each visual narrative segment stored within it to be easily categorized, retrieved, and played in the correct sequence.

Figure 11:
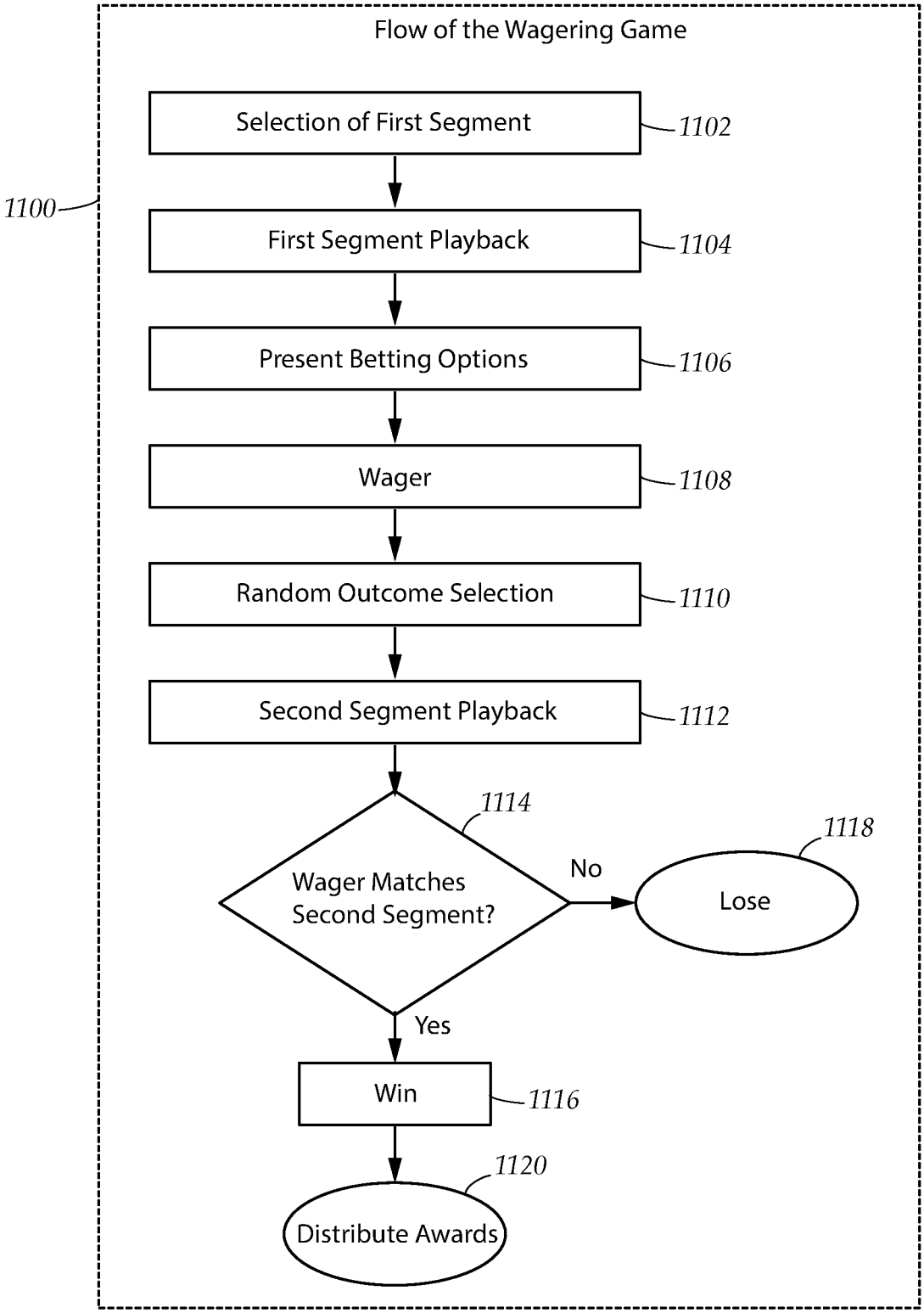
FIG. 11 depicts a process flow diagram for the wagering game, in accordance with an embodiment of the present disclosure.

FIG. 11 is a chart depicting the process flow of the wagering game 1100 as implemented on the game system 700 depicted in FIG. 7. Referring to FIGS. 7 and 11 simultaneously, the wagering game may start once the at least one player joins a live game at a gaming table 714 or interacts with a gaming machine 706. Once the wagering game starts, a first segment in a visual narrative sequence must be selected for use with the wagering game at the selection step 1102. The selected segment may be stored within the visual narrative repository 1001 as depicted in FIG. 10A. The Selection step may comprise a player selection, where the player may select a particular introduction segment or a scenario, a dealer selection where the dealer at the gaming table 714 selects a particular segment or a scenario, or a random selection where either the game server 702 or a gaming machine randomly selects an introduction segment or a scenario. The selection can be based on the segment characteristics 1006 depicted in FIG. 10A. Referring to FIGS. 7 and 10A simultaneously, a specific visual narrative segment can be chosen by name as referenced against the segment ID 1007, or by a keyword 1011 such as the genre ID or the author ID. For example, this allows the player to select the player's favorite segment or scenario, or to select a segment or scenario based on the player's preferred genre. The player may convey the selection through the gaming machine 706, or by communicating the selection to the dealer. Similarly, the dealer may select a segment using the described segment characteristics 1006 based on what the dealer believes may interest the players. Likewise, the game machine 706 may randomly select a segment using one or more of a playlist comprising a plurality of visual narrative segments generated and tailored according to the segment characteristics 1006, based on what may interest the players.

Returning to FIG. 11, once a particular visual narrative segment or scenario has been selected, the First Segment Playback step 1104 begins. Referencing FIGS. 7 and 8A-B simultaneously, the selected visual narrative segment or the introduction segment of the selected scenario is presented to each player as the first segment via a display 704, or via the gaming machine display 822 of the gaming machine 706.

Next, referring once again to FIG. 11, the Present Betting Options step 1106 begins. Once the first segment has been presented, each player is presented with a summary describing each of the possible outcome segments associated with the first segment. As shown in FIG. 10A, the possible outcome segments associated with the first segment can be identified by referencing the following segment ID for the first segment. Each player is further presented with a list of betting options 20 corresponding to each of the possible outcome segments, as depicted in FIG. 3, and the summary and the list of betting options 20 may be presented on a gaming display 704, or if the wagering game is being played on a suitably configured gaming machine 706, via the gaming machine display 822 as depicted in FIG. 7 and FIG. 8B.

Returning to FIG. 11, each player may place at least one wager during the Wager step 1108. A wager may be placed using a gaming machine or at a gaming table. As described in FIG. 3, each betting option 21 corresponds to a particular possible outcome segment 18 and may also indicate the outcome probability 24 and award factor 25. Each player may then place a wager by selecting one betting option, such as betting option "B" 23, and setting the wager amount 22. Each player may place an additional wager by selecting a different betting option 21 and setting the wager amount 22 for that betting option. Referring to FIGS. 3 and 8B simultaneously, the player may place a wager at the gaming machine 706 (FIG. 7) by selecting one of the betting options 21 and setting the wager amount 22 using the gaming machine input device 820. The player may supply the game currency for the wager amount by inserting bills, coins, or tokens using the input/output device 821, or by drawing game currency from a virtual wallet containing an amount of game currency. Each player may have a virtual wallet uniquely associated with each individual player. The virtual wallet can be implemented on the gaming machine 706, or on the game server 702 shown in FIG. 7. Referring to FIGS. 3 and 9 simultaneously, the player may also place a wager at a gaming table 714 by informing the dealer 908 of the player's selected betting option, and by placing game currency for the wager amount on the betting area 906. The gaming table 714 may also be configured to allow the player to draw currency from the player's virtual wallet.

Referring once again to FIG. 11, the Random Outcome Selection step 1110 begins once each player has finished placing at least one wager. Referring simultaneously to FIGS. 3 and 7, the random outcome selector 710 is used to generate a random outcome corresponding to one of the plurality of possible outcome segments shown in the list of betting options 20. The random outcome selector may comprise the deck of cards 40, dice 42, roulette wheel 44, or random number generator 46 as shown in FIGS. 4A-D, or any suitable apparatus commonly employed to generate random outcomes in casino games. As shown in FIG. 9, the random outcome selector 710 may be positioned on the gaming table 714 and operated by the dealer 908. The gaming machine 706 depicted in FIG. 8B may be configured to function as a random outcome selector, either by employing the gaming machine processor 812 as a random number generator or by implementing a virtual random outcome simulator on the gaming machine 706. The possible outcome segment selected by the random outcome selector becomes the second segment.

Returning to FIG. 11, the Second Segment Playback step 1112 begins once the second segment has been determined. The second segment is then retrieved and presented to each player via the at least one gaming display 704 as shown in FIG. 7, or via the at least one gaming machine display 822 shown in FIG. 8B, as appropriate depending on where the player is playing the wagering game. The dealer 908 may use the gaming table control unit 904 to select, retrieve, and present the second segment to the player 910 via the gaming display 704 as shown in FIG. 7 and FIG. 9.

Referring again to FIG. 11, once the second segment has been presented, the Wager Comparison step 1114 begins and each wager is compared to the second segment. Each wager comprises a prediction outcome corresponding to the possible outcome segment selected by the player as a betting option 21 as shown in FIG. 3. If the prediction outcome matches the second segment, the wager is a winning wager 1116. If the prediction outcome does not match the second segment, the wager is a losing wager 1118. If any wager is a winning wager, the Distribute Award step 1120 begins. Each player's wager can be compared with the second segment by the gaming machine 706 shown in FIG. 8B, and the gaming machine 706 may distribute the award as game currency using the input/output device 821 configured as a coin output, or may place the award into the player's virtual wallet. If the wagering game is played at the gaming table 714 shown in FIG. 9, the dealer 908 can compare each wager with the second segment and distribute the award for each winning wager to the player using game currency, or can use the gaming table control unit 904 to place the award into the player's virtual wallet. Once all awards have been distributed for each winning wager, or if there are no winning wagers, the wagering game ends.

Figure 12A:
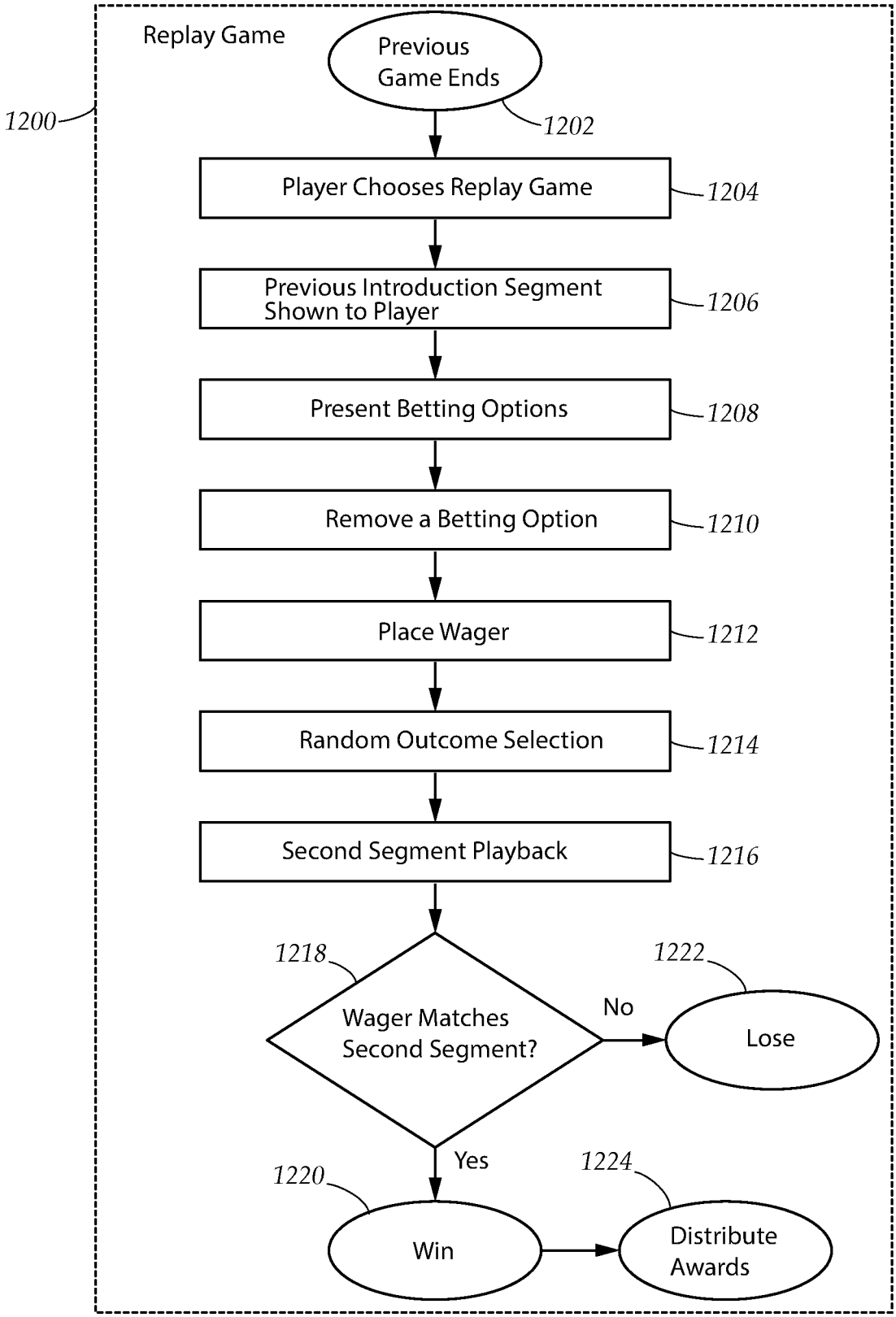
FIGS. 12A-B depict a process flow diagram for a repeat play variation of the wagering game, and an extended play variation of the wagering game, in accordance with an embodiment of the present disclosure.

FIG. 12A depicts a process flow illustrating the steps for playing a replay game 1200 as implemented on the game system 700 depicted in FIG. 7. At the conclusion of a wagering game 1202, each player may be invited to play a replay game at step 1204, and the replay game begins if any player choses to play. The replay game is played in a manner similar to the process shown in FIG. 11, and it would be apparent to one of ordinary skill in the art in the field of the invention to vary the methods and systems described in the present disclosure to implement the replay game. The first segment in the previous wagering game 1202 is automatically used again in the replay game as the new first segment, and is presented to each player 1206. Each player is then presented with a list of betting options 1208 corresponding to the possible outcome segments associated with the first segment. The replay game introduces a new variation in the wagering game at the remove betting option step 1210. Here, each player is given the option to remove one of the available betting options and its associated possible outcome segment by making a remove outcome selection designating one of the betting options. The possible outcome segment designated in the remove outcome selection will not be selected by the random outcome selector, thus narrowing the field of possible outcome segments that can be selected. If there is more than one player and more than one remove outcome selection is entered, the remove outcome selection selected by the most players will be chosen. Alternatively, the remove outcome selection which was entered the most quickly may be chosen. Once the remove outcome selection has been entered and the corresponding betting option has been removed, each player may place at least one wager 1212. The random outcome selector selects one possible outcome segment 1214 which will then be played back to each player as the new second segment 1216. Next, each wager is compared 1218 to determine winning wagers 1220 and losing wagers 1222, and awards are distributed for any winning wagers 1224. Once awards have been distributed for each winning wager, or if there are no winning wagers, the replay game ends.

Figure 12B:
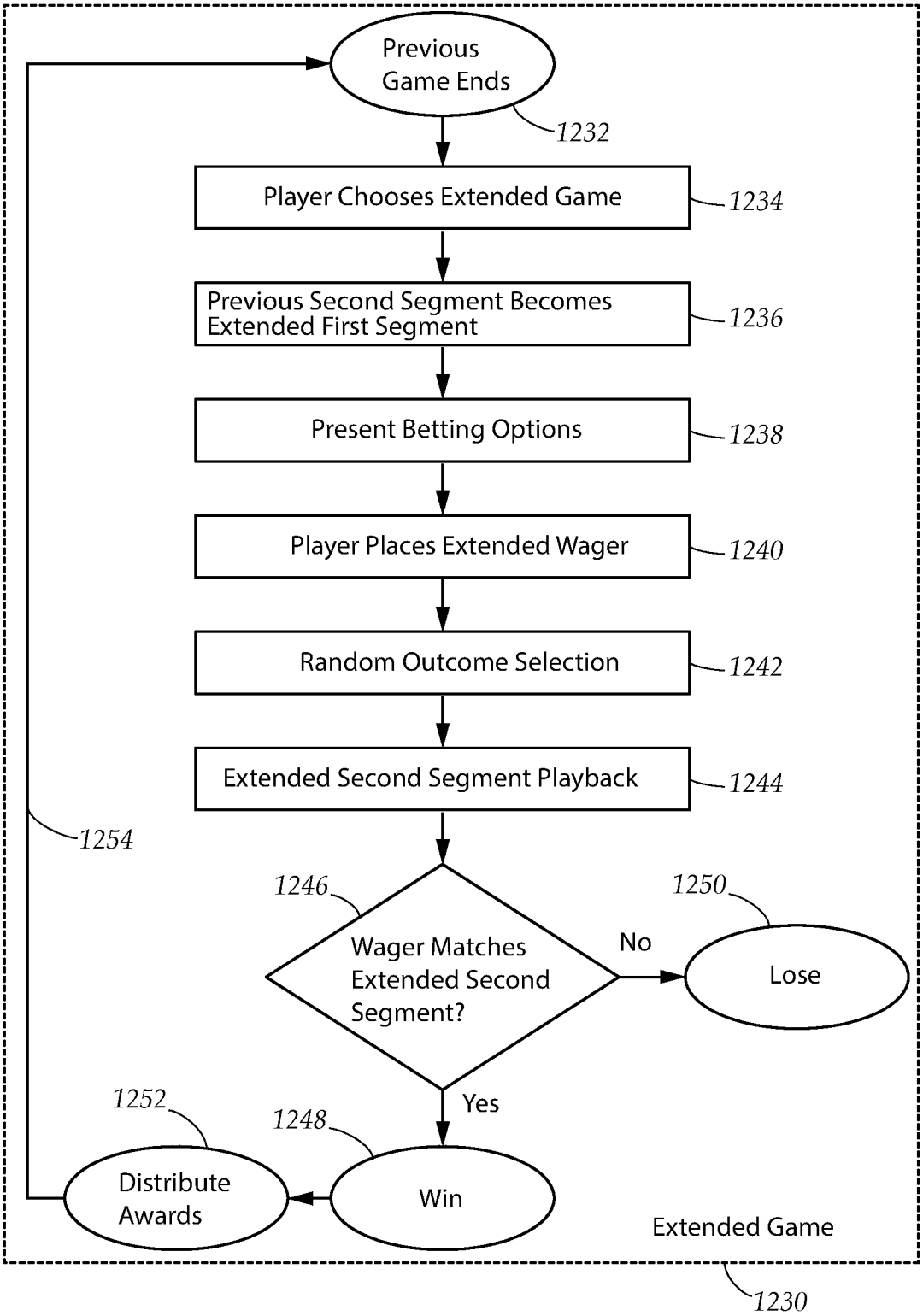

FIG. 12B depicts the process flow for an extended play game 1230 as implemented on the game system 700 depicted in FIG. 7. Referring to FIGS. 10B, 11, and 12B simultaneously, the extended play game can be played at the conclusion of a wagering game 1232, if a scenario 1026 comprising extended possible outcomes has been chosen at the Selection step 1102 at the start of the wagering game as shown in FIG. 11. If any player has placed a winning wager in the previously played wagering game, the player may choose to play the extended play game 1234. The extended play game is conducted in a manner similar to the process 1100 depicted in FIG. 11, and it would be apparent to a person of ordinary skill in the art in the field of the invention to vary the methods and systems described in the present disclosure to implement the extended play game 1230. In the extended play game, the second segment in the previous wagering game becomes an extended first segment 1236 in a new sequence of visual narrative segments comprising an extended first segment and an extended second segment, where the extended first segment has a plurality of possible extended outcome segments, and the extended second segment is randomly selected from the plurality of possible extended outcome segments. Each player is then presented with a summary describing each of the possible extended outcome segments along with a list of betting options corresponding to each of the possible extended outcome segments 1238. The betting options in the extended play game can be structured in the same manner as the betting options 21 as shown in FIG. 3, with each betting option in the extended play game further indicating the outcome probability 24 of the possible extended outcome being selected, and the award factor 25 describing the amount and nature of the award. Each player may then place at least one extended wager comprising an outcome prediction and a wager amount 1240, where the outcome prediction is a prediction of which of the possible extended outcome segments will be randomly selected as the extended second segment. Once all extended wagers have been placed, the extended second segment is randomly selected from the plurality of possible extended outcome segments in a process similar to the Random Outcome Selection step 1110 depicted in FIG. 11. Returning to FIG. 12B, the selected extended second segment is then presented to each player 1244, and each extended wager is compared with the extended second segment 1246. Each extended wager with an outcome prediction matching the extended second segment is a winning extended wager 1248, while every extended wager with an outcome prediction which does not match the extended second segment is a losing extended wager 1250. Once all extended wagers have been compared, awards are distributed to each player who placed a winning extended wager 1252.

Once all awards have been distributed for each winning extended wager, or if there are no winning extended wagers, the extended play game ends. However, as depicted in FIG. 12B, it is possible for another extended play game to be played immediately after the current extended play game by returning 1254 to step 1232. As shown in FIGS. 10A-B, a scenario 1026 may continue, where a possible extended outcome segment 1024 may itself further have a plurality of possible extended outcome segments 1024B, each identifiable by referencing the following segment ID 1010 for the possible extended outcome segment 1024. Returning to FIG. 12B, when the extended play game ends with an award being distributed for each at least one winning extended wager, and the selected extended second segment has a plurality of possible extended outcome segments, each player who has placed a winning extended wager may start a new extended play game 1234. This allows for the sequence of visual narrative segments to continue, providing an incentive for each player to continue playing in order to complete the sequence. Furthermore, the award factors in successive extended play games may increase, due to the decreasing probability that any player will continue to place winning extended wagers in successive extended play games, with the effect of making the extended play game both exciting and potentially lucrative.

Figure 13:
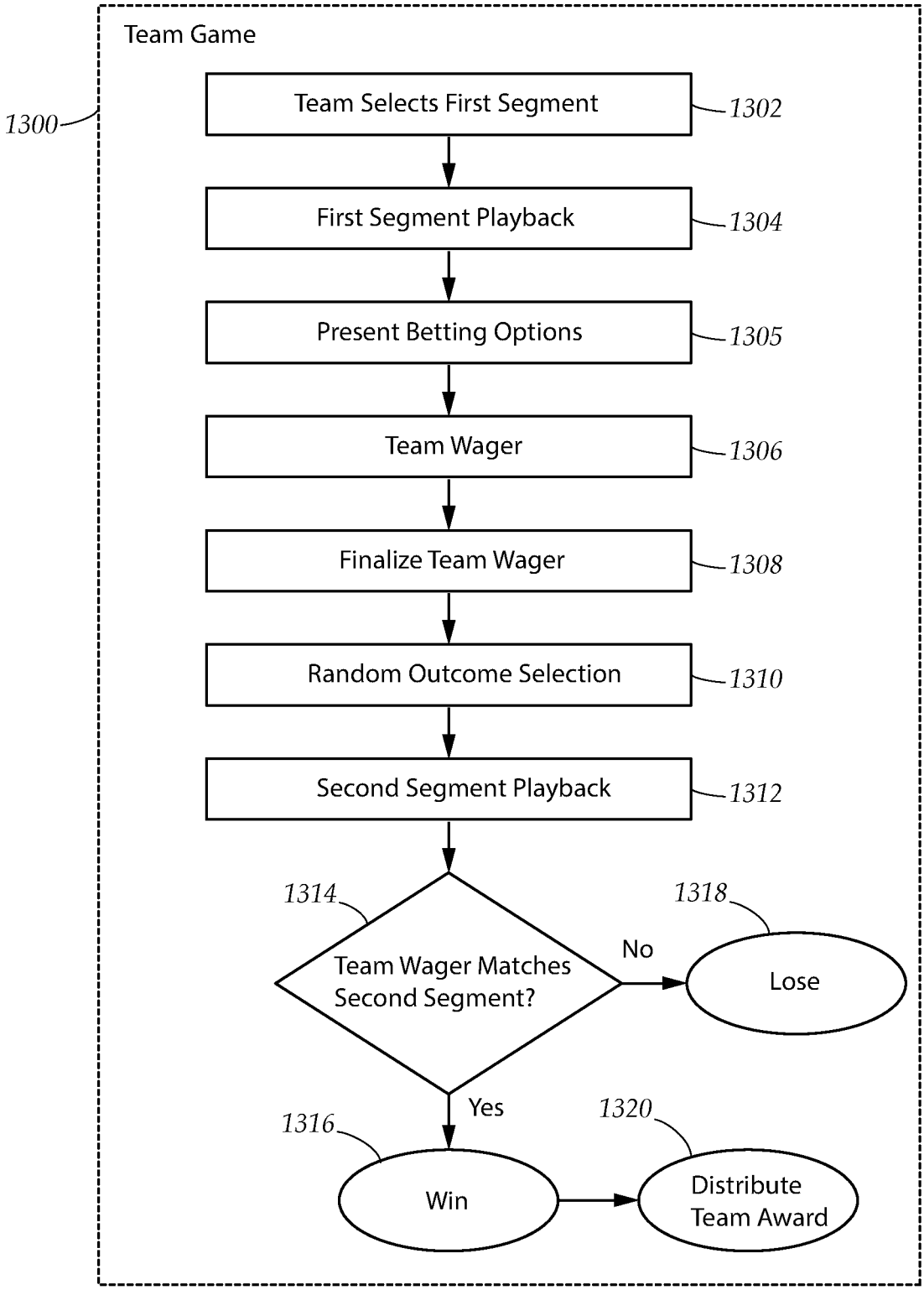
FIG. 13 depicts a process flow diagram for a wagering game played as a team game, in accordance with an embodiment of the present disclosure.

FIG. 13 shows a chart depicting the process flow for a team game 1300 as implemented on the game system 700 depicted in FIG. 7. The team game 1300 of FIG. 13 is similar to the wagering game process flow 1100 depicted in FIG. 11, with additional steps to allow for the team game to be played by at least one team comprising at least two of a team member, where each team member is a player. First, each team member selects a visual narrative segment at step 1302 to be the first segment in a sequence of visual narrative segments comprising a first segment having a plurality of possible outcome segments and a second segment randomly selected from the plurality of possible outcome segments. If each team member selects a different visual narrative segment, the visual narrative segment selected by the most team members is selected as the first segment. Alternatively, the visual narrative segment selected by the team member who made the quickest selection can be selected as the first segment. The first segment may also be chosen at random or by playlist, as described in the present disclosure. Once the first segment has been selected, the first segment is presented to each team member at step 1304. At step 1305, each team member is then shown a list of betting options corresponding to the plurality of possible outcome segments associated with the first segment. At step 1306, each team member may place a wager by selecting one of the betting options and setting a wager amount. At step 1308, a team wager is set with a team outcome prediction corresponding to the betting option selected by the most team members, and a team wager amount equal to the combined wager amount set by each team member. If each team member has selected a unique betting option, the betting option selected by the first team member to place a wager is selected for the team wager. Next, the second segment is randomly selected from the plurality of possible outcome segments at step 1310, and the selected second segment is presented to each team member at step 1312. The team wager is compared with the selected second segment at step 1314. If the team wager has a team outcome prediction matching the second segment, the team wager is a winning team wager 1316, but if the team has a team outcome prediction which does not match the second segment, it is a losing team wager 1318. At step 1320, a team award is distributed to the team if it placed a winning team wager. Each team member of the winning team receives an award amount in proportion to the wager amount the team member contributed towards the total team wager amount. Once a team award has been distributed for any winning team wagers, or if there are no winning team wagers, the team game ends. Referring to FIGS. 12A, 12B, and 13 simultaneously, the team game 1300 may be combined with the replay game 1200, the extended play game 1230, or a combination thereof, in order to allow each variant of the wagering game to be played by a team, as will be appreciated by a person of ordinary skill in the art in the field of the invention.

Figure 14:
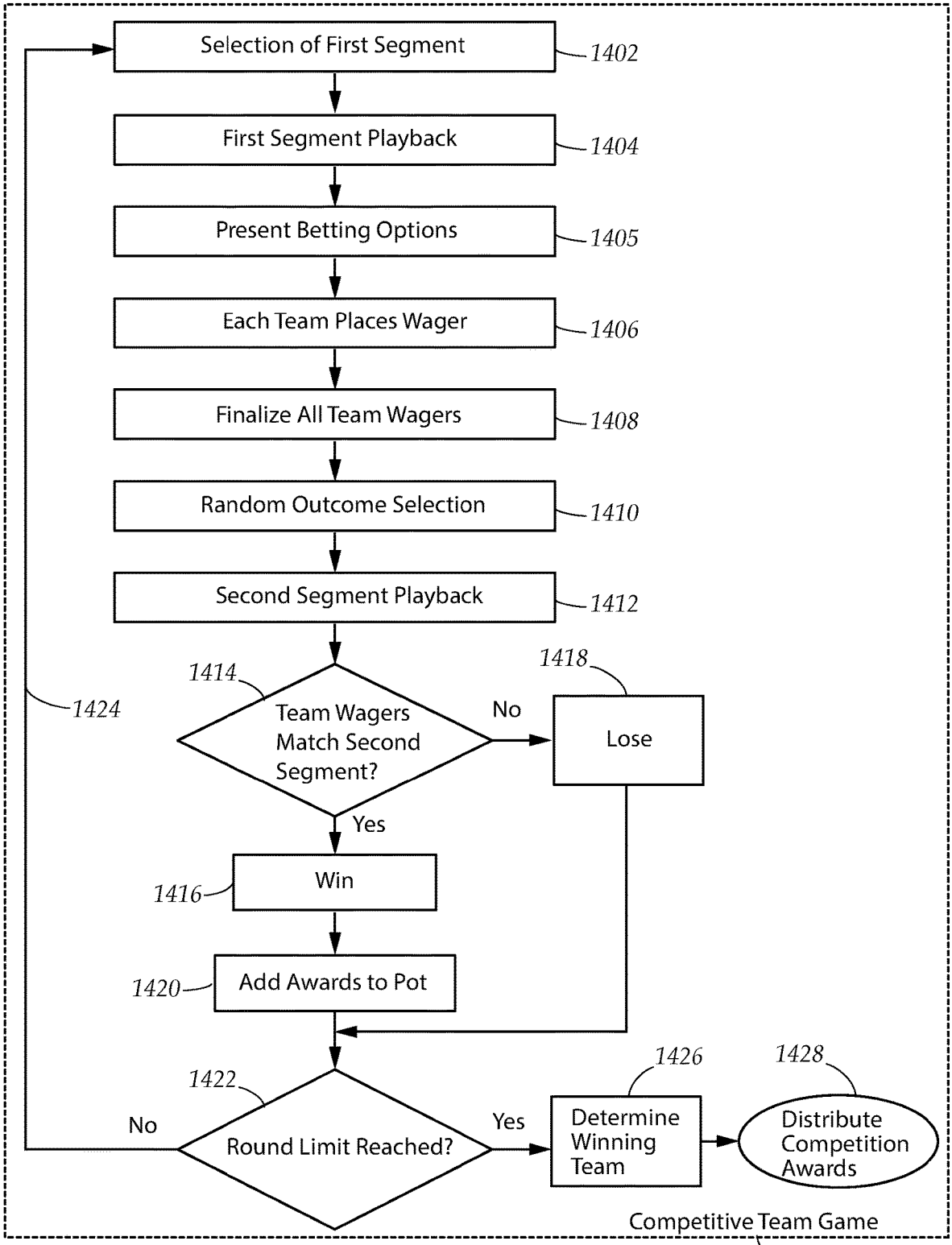
FIG. 14 depicts a process flow diagram for a wagering game played as a competitive team game, in accordance with an embodiment of the present disclosure.

FIG. 14 is a flow chart depicting the process flow for a competitive team game 1400 as implemented on the game system 700 shown in FIG. 7. Referencing FIGS. 13 and 14 simultaneously, the competitive team game 1400 is a variation of the team game 1300, where the competitive team game 1400 is played by a plurality of teams over a number of rounds equal to a round limit. All awards in the competitive team game are placed in a competitive pot, and the team with the highest pot contribution total wins the competitive game. The competitive team game begins at step 1402, where a visual narrative segment is randomly selected from the plurality of visual narrative segments stored within the game system 700 (FIG. 7). The selected visual narrative segment becomes the first segment in a new sequence of visual segments comprising a first segment having a plurality of possible outcome segments and a second segment randomly selected from the plurality of possible outcome segments. The selected first segment is then presented to each team 1404. At step 1405, each team is presented with a list of betting options corresponding to each of the possible outcome segments, and wagers are set by each member of each team at step 1406. As in step 1308 shown in FIG. 13, the individual wagers of each member of a team are combined to form a team wager. Next, at step 1410, the second segment is randomly selected from the plurality of possible outcome segments and is presented to each team at step 1412. At step 1414, each team wager is then compared to the second segment to determine whether the team wager is a winning team wager 1416 or a losing team wager 1418. The award for each winning team wager is then placed in the competitive pot 1420, and the game system 700 (FIG. 7) further maintains the pot contribution total for each team to track the total amount of reward contributed by each team. At step 1422, if the number of rounds of the competitive game played so far is less than the round limit, the competitive game continues 1424 and returns to step 1402. If the number of rounds of the competitive game played so far is equal to the round limit, then the competitive game proceeds to step 1426 and determines the winning team. The team which has the highest pot contribution total is the winning team, and the accumulated award amount within the competitive pot is distributed at step 1428. The award within the competitive pot may be distributed between each team in a variety of ways. The winning team may receive a portion of the award, while the remainder of the reward is divided between each losing team. Alternatively, the winning team may receive the entire award amount. After step 1428, the competitive game ends.

As will be appreciated by one skilled in the art, aspects of the present disclosure may be embodied as a system, method or computer program product. Accordingly, aspects of the present disclosure may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium (including, but not limited to, non-transitory computer readable storage media). A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate or transport a program for use by or in connection with an instruction execution system, apparatus or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Smalltalk, C++ or the like and conventional procedural programming languages, such as the "C" programming language or similar programming languages. Other types of languages include XML, XBRL and HTML5. The program code may execute entirely on the user's computer, partly on the user's computer, as a stand-alone software package, partly on the user's computer and partly on a remote computer or entirely on the remote computer or server. In the latter case, the remote computer may be connected to the user's computer through any type of network, including a local area network (LAN) or a wide area network (WAN), or the connection may be made to an external computer (for example, through the Internet using an Internet Service Provider).

Aspects of the present disclosure are described below with reference to flowchart illustrations and/or block diagrams of methods, apparatus (systems) and computer program products according to embodiments of the disclosure. Each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality and operation of possible implementations of systems, methods and computer program products according to various embodiments of the present disclosure. In this regard, each block in the flowchart or block diagrams may represent a module, segment or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. Each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

The flow diagrams depicted herein are just one example. There may be many variations to this diagram or the steps (or operations) described therein without departing from the spirit of the disclosure. For instance, the steps may be performed in a differing order and/or steps may be added, deleted and/or modified. All of these variations are considered a part of the claimed disclosure.

In conclusion, herein is presented a method and apparatus allowing a wager to be placed to predict a second segment in a sequence of visual narrative segments. The disclosure is illustrated by example in the drawing figures, and throughout the written description. It should be understood that numerous variations are possible, while adhering to the inventive concept. Such variations are contemplated as being a part of the present disclosure.

What is claimed is:

1. A computer-implemented method for playing a single wagering game, comprising the steps of:

providing a game system comprising: a game server having a game server storage device that is accessible over a computer network, a gaming machine comprising a processor, memory, a gaming machine input device, a gaming display, and a random outcome selector comprising a random number generator;

providing and storing a plurality of visual narrative segments of the single wagering game, each of which providing one or more events of the single wagering game in visual form;

associating a different plurality of different betting outcome segments with each of the plurality of visual narrative segments, and storing each of the pluralities of betting outcome segments;

sequentially performing:

receiving a selection of one of the provided plurality of visual narrative segments, via the gaming machine input device;

responsive to the received selection, retrieving, from at least one of the memory and the game server storage device, the selected one of the stored plurality of visual narrative segments and presenting the retrieved visual narrative segment on the gaming display;

presenting a plurality of betting options on the gaming display depending upon the retrieved visual narrative segment, each of the plurality of betting options corresponding to one of the stored plurality of betting outcome segments associated with the retrieved visual narrative segment;

receiving, via the gaming machine input device, a selection of one of the plurality of betting options from a player of the single wagering game, the selected betting option triggering a wager comprising a predicted betting outcome corresponding to one of the plurality of betting outcome segments associated with the retrieved visual narrative segment and a wager amount corresponding to an amount of a game currency;

using an output of the random number generator of the random outcome selector, generating a random betting outcome corresponding to one of the stored plurality of betting outcome segments;

selecting and retrieving the stored betting outcome segment that corresponds to the generated random betting outcome and presenting the retrieved betting outcome segment on the gaming display, the plurality of betting outcome segments from which the stored betting outcome segment is selected being dependent upon the received selection of the visual narrative segments;

comparing, using at least one of the processor and the game server, the predicted betting outcome with the generated random betting outcome and determining that the received wager is a winning wager when the betting outcome segment corresponding to the predicted betting outcome matches the retrieved betting outcome segment corresponding to the generated random betting outcome; and distributing an award for each winning wager, where the award comprises an amount of game currency at least equal to the wager amount of the winning wager.

2. The computer-implemented method of claim 1, wherein each of the pluralities of visual narrative segments and the plurality of betting outcome segments are stored in the gaming machine.

3. The computer-implemented method of claim 1, wherein each of the pluralities of visual narrative segments and the plurality of betting outcome segments are stored in the gaming server storage device.

4. The computer-implemented method of claim 1, wherein each of each of the pluralities of betting outcome segments is associated with an outcome probability and an award factor corresponding to a multiplier that is inversely proportional to the outcome probability; and wherein the award comprises an amount of game currency at least equal to the wager amount of the winning wager, multiplied by the award factor.

5. The computer-implemented method of claim 1, further comprising:

storing each of the pluralities of visual narrative segments within a visual narrative repository implemented as a database stored within the game server storage device or within the gaming machine, each of each of the pluralities of visual narrative segments within the visual narrative repository being represented by a repository entry having a plurality of data fields comprising a segment identifier identifying the visual narrative segment, a previous segment ID identifying the segment preceding the visual narrative segment in a sequence of visual narrative segments, a following segment ID identifying a plurality of possible outcome segments associated with the visual narrative segment, and at least one genre ID describing the narrative genre depicted in the visual narrative segment; and retrieving the visual narrative segment from the visual narrative repository, based on the at least one genre ID of the visual narrative segment.

6. The computer-implemented method of claim 1, wherein the single wagering game is configured to be played by a team comprising at a least two players, wherein the wager comprises a team wager and wherein the award for a winning wager is distributed to the at least two players of the team.

7. A game system for playing a single wagering game, comprising:

a game server having a game server storage device that is accessible over a computer network, a gaming machine comprising a processor, memory, a gaming machine input device, a gaming display, and a random outcome selector;

a plurality of stored visual narrative segments of the single wagering game, each of which providing one or more events of the single wagering game in visual form;

a different plurality of stored different betting outcome segments associated with each of the plurality of visual narrative segments;

wherein the game system is configured to receive a selection of one of the provided plurality of visual narrative segments and to retrieve the selected one of the stored plurality of visual narrative segments, present the retrieved visual narrative segment on the gaming display and sequentially:

present a plurality of betting options on the gaming display depending upon the retrieved visual narrative segment, each of the plurality of betting options corresponding to one of the stored plurality of betting outcome segments associated with the retrieved visual narrative segment;

receive, via the gaming machine input device, a selection of one of the plurality of betting options from a player of the single wagering game, the selected betting option triggering a wager comprising a predicted betting outcome corresponding to one of the plurality of betting outcome segments associated with the retrieved visual narrative segment and a wager amount corresponding to an amount of a game currency;

using an output of the random number generator of the random outcome selector, generate a random betting outcome corresponding to one of the stored plurality of betting outcome segments;

select and retrieve the stored betting outcome segment that corresponds to the generated random betting outcome and present the retrieved betting outcome segment on the gaming display, the plurality of betting outcome segments from which the stored betting outcome segment is selected being dependent upon the received selection of the visual narrative segments;

compare, using at least one of the processor and the game server, the predicted betting outcome with the generated random betting outcome and determine that the received wager is a winning wager when the betting outcome segment corresponding to the predicted betting outcome matches the retrieved betting outcome segment corresponding to the generated random betting outcome; and distribute an award for each winning wager, where the award comprises an amount of game currency at least equal to the wager amount of the winning wager.

8. The game system of claim 7, wherein each of the pluralities of visual narrative segments and the plurality of betting outcome segments are stored in the gaming machine.

9. The game system of claim 7, wherein each of the pluralities of visual narrative segments and the plurality of betting outcome segments are stored in the gaming server storage device.

10. The game system of claim 7, wherein each of each of the pluralities of betting outcome segments is associated with an outcome probability and an award factor corresponding to a multiplier that is inversely proportional to the outcome probability; and wherein the award comprises an amount of game currency at least equal to the wager amount of the winning wager, multiplied by the award factor.

11. The game system of claim 7, wherein the game system is further configured to store each of the pluralities of visual narrative segments within a visual narrative repository implemented as a database stored within the game server storage device or within the gaming machine, each of each of the pluralities of visual narrative segments within the visual narrative repository being represented by a repository entry having a plurality of data fields comprising a segment identifier identifying the visual narrative segment, a previous segment ID identifying the segment preceding the visual narrative segment in a sequence of visual narrative segments, a following segment ID identifying a plurality of possible outcome segments associated with the visual narrative segment, and at least one genre ID describing the narrative genre depicted in the visual narrative segment; and retrieve the visual narrative segment from the visual narrative repository, based on the at least one genre ID of the visual narrative segment.

12. The game system of claim 7, wherein the wagering game is configured to be played by a team comprising at a least two players, wherein the wager comprises a team wager and wherein the award for a winning wager is distributed to the at least two players of the team.

* * * * *